US008331820B2

(12) United States Patent
Saitoh

(10) Patent No.: US 8,331,820 B2
(45) Date of Patent: Dec. 11, 2012

(54) FIXING DEVICE AND IMAGE FORMING APPARATUS USING SAME

(75) Inventor: Seiji Saitoh, Zama (JP)

(73) Assignee: Ricoh Company, Limited, Tokyo (JP)

( * ) Notice: Subject to any disclaimer, the term of this patent is extended or adjusted under 35 U.S.C. 154(b) by 301 days.

(21) Appl. No.: 12/868,209

(22) Filed: Aug. 25, 2010

(65) Prior Publication Data

US 2011/0064440 A1 Mar. 17, 2011

(30) Foreign Application Priority Data

Sep. 14, 2009 (JP) ..... 2009-211618
May 19, 2010 (JP) ..... 2010-115405

(51) Int. Cl.
*G03G 15/20* (2006.01)

(52) U.S. Cl. ..... 399/69; 399/122; 399/329

(58) Field of Classification Search ..... 399/38, 399/67–70, 107, 122, 320, 328–331; 219/216, 219/619

See application file for complete search history.

(56) References Cited

U.S. PATENT DOCUMENTS

| | | | | |
|---|---|---|---|---|
| 5,138,379 | A | 8/1992 | Kanazashi | |
| 5,722,012 | A | 2/1998 | Saitoh | |
| 6,104,889 | A | 8/2000 | Saitoh | |
| 6,816,701 | B2 | 11/2004 | Saitoh | |
| 7,369,787 | B2 | 5/2008 | Otsuka | |
| 7,493,059 | B2 | 2/2009 | Saitoh | |
| 2002/0118982 | A1 * | 8/2002 | Fuma | 399/329 |
| 2003/0021616 | A1 * | 1/2003 | Yoda et al. | 399/329 |
| 2004/0052542 | A1 * | 3/2004 | Kinoshita | 399/69 |
| 2008/0187340 | A1 | 8/2008 | Otsuka | |

FOREIGN PATENT DOCUMENTS

| | | |
|---|---|---|
| JP | 4-42186 | 2/1992 |
| JP | 10-254281 | 9/1998 |
| JP | 2002-341681 | 11/2002 |
| JP | 3443716 | 6/2003 |
| JP | 2005-345488 | 12/2005 |
| JP | 4201181 | 10/2008 |

* cited by examiner

*Primary Examiner* — Hoan Tran
(74) *Attorney, Agent, or Firm* — Oblon, Spivak, McClelland, Maier & Neustadt, L.L.P.

(57) ABSTRACT

The fixing device includes first and second heat sources, a rotatable fixing member heated by the first heat source, a rotatable pressing member heated by the second heat source and contacting the fixing member to form a fixing nip therebetween at which a toner image on a sheet is fixed thereto, and at least first and second temperature detectors determining temperatures of different surface portions of the pressing member. The pressing member has a width greater than that of the fixing member greater than the maximum width of the sheet accommodated by the fixing device. The first temperature detector determines the temperature of a surface portion of the pressing member, which is to be contacted with the sheet, and the second temperature detector determines the temperature of a second surface portion of the pressing member, which is not contacted with the fixing member even when the pressing member is rotated.

7 Claims, 7 Drawing Sheets

FIXING DEVICE AND IMAGE FORMING APPARATUS USING SAME

BACKGROUND OF THE INVENTION

1. Field of the Invention

The present invention relates to a fixing device for fixing a toner image to a receiving material upon application of heat and pressure thereto, and to an image forming apparatus having the fixing device.

2. Discussion of the Related Art

Electrophotographic image forming apparatuses such as copiers and laser printers form an image by performing the following processes:

(1) forming an electrostatic latent image on an image bearing member;

(2) developing the electrostatic latent image using a developing device to form an unfixed toner image on the image bearing member;

(3) transferring the unfixed toner image onto a receiving material (such as paper sheets); and (4) fixing the toner image to the receiving material using a fixing device.

A key component is the fixing device, and various fixing devices have been proposed. Specific examples thereof include heat roller fixing devices and belt fixing devices. In heat roller fixing devices, a receiving material bearing an unfixed toner image is passed through a fixing nip formed by a fixing roller having a heater therein and a pressing roller contacting the fixing roller, so that the unfixed toner image is fixed to the receiving material upon application of heat and pressure at the fixing nip. In belt fixing devices, a receiving material bearing an unfixed toner image is passed through a fixing nip formed by an endless fixing belt tightly stretched by a fixing roller and a heating roller while heated by the heating roller and pressed against a pressing roller contacting the fixing roller with the fixing belt therebetween, so that the unfixed toner image is fixed to the receiving material upon application of heat and pressure at the fixing nip.

Since there is an optimum temperature for fixing a toner image, the temperature of each of the fixing member (whether a roller or a belt) and the pressing member is typically controlled so as to fall in a temperature range including the optimum temperature by automatically providing or turning off electricity to heat sources for heating the fixing member and the pressing member. Such automatic control is achieved, for example, by a method including measuring the temperatures of a fixing member and a pressing member using a contact temperature detector (such as a thermistor) contacted with the fixing member and pressing member or a non-contact temperature detector (such as thermopiles using infrared rays), and sending the detected temperature information to a temperature controller to control power supply to heat sources for heating the fixing member and the pressing member.

However, even when the temperature is controlled as described above, the fixation property of a fixed image still varies somewhat depending on ambient temperature and humidity. Specifically, when the ambient temperature is low, the temperature of a receiving material declines, thereby degrading the fixation property of an image fixed on the receiving material. Similarly, when the ambient humidity is high, a recording paper absorbs a large amount of moisture, thereby degrading the fixation property of an image fixed on the receiving material.

In attempting to prevent deterioration of the fixation property, a fixing device is proposed which detects the ambient temperature and humidity using a detector to control the temperature of a fixing member based on the output from the detector. In addition, an image forming apparatus is proposed in which a temperature difference between a fixing member and a pressing member is controlled so as to fall in a predetermined range to maintain the fixation property.

However, heat transfer from the fixing member to the pressing member is not considered in the proposed fixing device and image forming apparatus. Therefore, the temperature of the pressing member cannot be controlled in the desired range, resulting in formation of a curled print.

For these reasons, the inventor recognized that there is a need for an image forming apparatus capable of producing prints having a good fixing property without curling.

SUMMARY

This patent specification describes a novel fixing device for fixing a toner image formed on a recording sheet, one embodiment of which includes a heating member heated by a first heat source, a pressing member heated by a second heat source and contacting the heating member to form a fixing nip therebetween at which the toner image is fixed to the recording sheet, and at least two temperature detectors configured to determine temperatures of different surface portions of the pressing member. The width of the pressing member is greater than the width of the fixing member which is greater than the maximum width of the recording sheet. One of the temperature detectors detects the temperature of a first surface portion of the pressing member, which portion is contacted with the recording sheet when the recording sheet is fed to the fixing nip, and another temperature detector detects the temperature of a second surface portion of the pressing member, which portion is not contacted with the fixing member even when the pressing member is rotated.

This patent specification further describes a novel image forming apparatus, one embodiment of which includes an image forming device configured to form a toner image on a recording sheet, and the above-mentioned fixing device configured to fix the toner image to the recording sheet.

BRIEF DESCRIPTION OF THE DRAWINGS

A more complete appreciation of aspects of the invention and many of the attendant advantage thereof will be readily obtained as the same become better understood by reference to the following detailed description when considered in connection with the accompanying drawings, wherein.

DESCRIPTION OF THE PREFERRED EMBODIMENTS

In the present application, "waiting time (or waiting state)" of an image forming apparatus is defined as a time (state) in which the image forming apparatus has not yet performed an image forming operation after performing a start-up operation, and each of a fixing member and a pressing member of a fixing device of the apparatus maintains a predetermined temperature lower than a fixable temperature.

In addition, "returning time (state)" is defined as a time (state) of the image forming apparatus in which the fixing member and pressing member in the waiting state are heated to respective predetermined temperatures.

Further, "start-up operation time (state)" is defined as a time (state) of the image forming apparatus in which the image forming apparatus is started up by turning on a main switch thereof.

Furthermore, "sheet feeding time (state)" is defined as a time (state) of the image forming apparatus of from an order of printing (i.e., start of an image forming operation) to discharging of a print (i.e., detection of discharging of a print with a discharge detector).

In addition, "continuous sheet feeding time (state)" is defined as a time (state) in which the above-mentioned printing operation is continuously performed to produce multiple prints.

Figure 1:
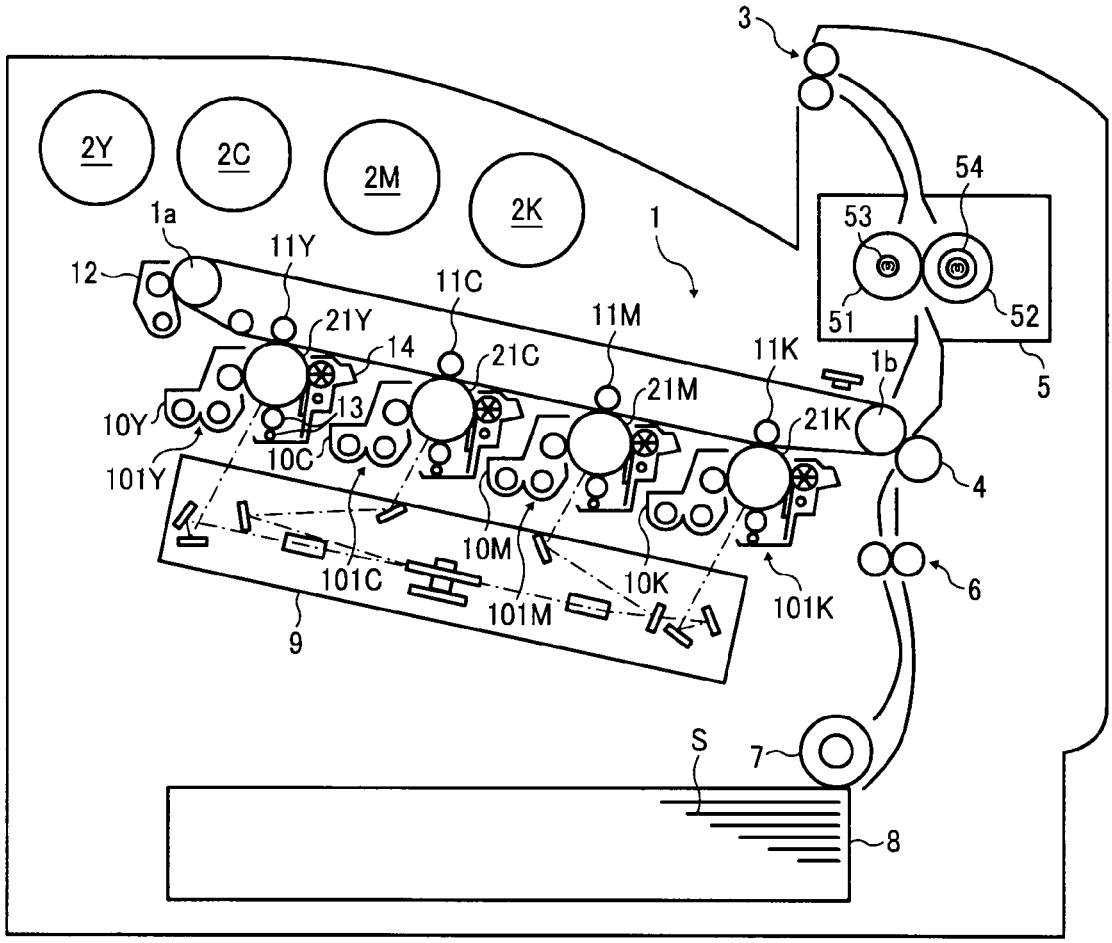
FIG. 1 is a schematic view illustrating a color laser printer as one example of the image forming apparatus of the present invention.

FIG. 1 is a schematic view illustrating a color laser printer as one example of the image forming apparatus of the present invention.

Referring to FIG. 1, the color laser printer includes a tandem image forming section, in which yellow, cyan, magenta and black image forming units 101Y, 101C, 101M and 101K serving as toner image forming devices are arranged side by side in this order. In this regard, suffixes Y, C, M and K mean that the parts and devices are used for forming yellow, cyan, magenta and black color images, respectively, and the suffixes are sometimes omitted. The image forming units 101 include respective photoreceptors 21Y, 21C, 21M and 21K serving as electrostatic latent image bearing members. In addition, the image forming units 101 include developing devices 10Y, 10C, 10M and 10K configured to develop electrostatic latent images on the photoreceptors 21 with respective color developers to form yellow, cyan, magenta and black color toner images on the photoreceptors, cleaners 14 configured to clean the surfaces of the respective photoreceptors, chargers 13 configured to charge the respective photoreceptors, etc., which devices are arranged around the photoreceptors. In addition, the printer has four toner bottles 2Y, 2C, 2M and 2K configured to contain respective color toners and arranged on an upper portion thereof. The color toners in the toner containers 2 are supplied in proper amounts to the respective developing devices 10Y, 10C, 10M and 10K through respective feeding passages so that the developers in the developing devices maintain predetermined toner concentrations.

A light irradiating device 9 serving as an electrostatic latent image forming device is provided below the tandem image forming section. The light irradiating device 9 includes a light source, a polygon mirror, a f-θ lens, a reflection mirror, etc., and scans each photoreceptor 21 with laser light according to image data to form an electrostatic latent image on the photoreceptor.

An endless intermediate transfer belt 1 serving as an intermediate transfer medium is provided above the tandem image forming section. The intermediate transfer belt 1 is tightly stretched by a driving roller 1*a* and a driven roller 1*b*, wherein a driving motor (not shown) is connected with a shaft of the driving roller. When the driving motor is driven, the driving roller 1*a* is rotated, and the intermediate transfer belt 1 is rotated (counterclockwise in FIG. 1) while the driven roller 1*b* is rotated by the intermediate transfer belt. Primary transfer members 11Y, 11C, 11M and 11K are provided inside the intermediate transfer belt 1 to sequentially transfer color toner images formed on the photoreceptors 21Y, 21C, 21M and 21K onto the intermediate transfer belt, resulting in formation of a combined color toner image on the intermediate transfer belt.

A secondary transfer roller 4 serving as a secondary transfer member is provided downstream from the primary transfer members 11 relative to the moving direction of the intermediate transfer belt 1. The secondary transfer roller 4 is opposed to the driven roller 1*b* with the intermediate transfer belt 1 therebetween to press the intermediate transfer belt to the driven roller, thereby forming a secondary transfer nip.

The printer further includes a recording sheet cassette 8 configured to contain a stack of recording sheets S, a sheet feeding roller 7 configured to feed the uppermost recording sheet, a pair of registration rollers 6, etc.

A fixing device 5 configured to fix a toner image on the recording sheet S, and a pair of discharging rollers 3 are provided downstream from the secondary transfer roller 4 relative to the feeding direction of the recording sheet S.

Next, the operation of the printer will be described.

In each image forming unit 101, the photoreceptor 21 is rotated, and the charger 13 evenly charges the surface of the photoreceptor. Next, the light irradiating device 9 irradiates the charged photoreceptor 21 with laser light to form an electrostatic latent image on the photoreceptor. The developing device 10 develops the electrostatic latent image with a color toner to form a color toner image on the photoreceptor 21. Thus, yellow, cyan, magenta and black color images are formed on the photoreceptors 21Y, 21C, 21M and 21K, respectively. In addition, a driving motor (not shown) rotates the driving roller 1*a* to rotate the intermediate transfer belt 1 while rotating the driven roller 1*b* and the second transfer roller 4. The color toner images formed on the photoreceptors 21Y, 21C, 21M and 21K are sequentially transferred onto the intermediate transfer belt 1 by the respective primary transfer members 11Y, 11C, 11M and 11K, resulting in formation of a combined color toner image on the intermediate transfer belt. After the color toner images are transferred, the surfaces of the photoreceptors 21 are cleaned by the respective cleaners 14 so as to be ready for the next image forming operation.

Meanwhile, the recording sheet S is fed from the sheet cassette 8 by the feeding roller 7. The thus-fed recording sheet S is stopped once by the pair of registration rollers 6, and then fed timely toward the secondary transfer nip formed by the secondary transfer roller 4 and the intermediate transfer belt 1 so that the combined toner image on the intermediate transfer belt is transferred onto a proper position of the recording sheet at the secondary transfer nip.

After the secondary transfer operation, the recording sheet S bearing the combined color toner image thereon is fed to the fixing device 5 so that the combined color toner image is fixed to the recording sheet upon application of heat and pressure at a fixing nip formed by a fixing roller 51 having a first heat source 53 therein and a pressing roller 52 having a second heat source 54 therein and contacting the fixing roller 51. The recording sheet S bearing the fixed combined color toner image (i.e., a full color image) thereon is then discharged from the main body of the printer by the pair of discharging rollers 3, resulting in formation of a full color print. After the secondary transfer operation, the surface of the intermediate transfer belt 1 is cleaned by a belt cleaner 12 so that the intermediate transfer belt is ready for the next primary transfer operation.

Next, the configuration of the fixing device of the present invention will be described. Hereinafter, a roller fixing device will be described as one example of the fixing device of the present invention, but the present invention is not limited thereto.

Figure 2:
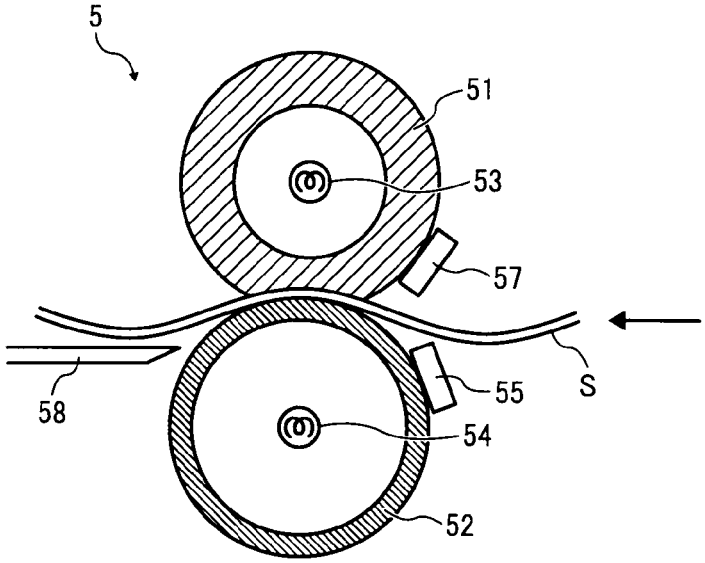
FIG. 2 is a schematic cross-sectional view illustrating a roller fixing device for use in the image forming apparatus.

The fixing device 5 illustrated in FIG. 2, which is an example of the fixing device of the present invention, includes the fixing roller 51 serving as a fixing member, the pressing roller 52 serving as a pressing member, the first heat source 53 for heating the fixing roller, the second heat source 54 for heating the pressing roller, temperature detectors 55 and 57, a separating member 58 for separating the recording sheet S from the fixing roller, a guide plate (not shown), etc. Although in FIG. 2 the temperature detectors 55 and 57 are respectively contacted with the pressing roller 52 and the fixing roller 51, the detectors need not necessarily be contacted therewith provided they are able to detect the temperatures of the pressing roller 52 and the fixing roller 51.

The fixing roller 51 has such a configuration that an elastic layer made of a foamed material such as foamed silicone rubbers is formed on a metal shaft, so that a desired fixing nip can be formed between the fixing roller 51 and the pressing roller 52.

The first and second heat sources 53 and 54 are respectively provided inside the fixing roller 51 and pressing roller 52. A controller (illustrated in FIG. 5) controls supply of electricity to the first and second heat sources based on the temperatures detected by the temperature detectors 55 and 57 such as thermistors to control the temperatures of surfaces of the fixing roller 51 and pressing roller 52. Specific examples of the first and second heat sources include halogen heater, infrared heaters, induction heaters, thermal resistors, etc.

The fixing device 5 operates such that when a main switch of the printer is turned on, a high frequency power is supplied to the first and second heat sources 53 and 54 by an electric power source, and the fixing roller 51 and pressing roller 52 start to be rotated.

The recording sheet S bearing the combined color toner image thereon is fed to the fixing nip of the fixing device 5 as indicated by an arrow illustrated in FIG. 2. The combined color toner image is fixed to the recording sheet S at the fixing nip by the heat and pressure applied by the fixing roller 51 and pressing roller 52. After passing the fixing nip, the recording sheet S is separated from the fixing roller 51 by the separating member 58.

Next, the effect of heat of a fixing member (fixing roller 51) on the temperature of the surface of a pressing member (pressing roller 52) will be described with reference to FIG. 3, which illustrates temperature distribution of the pressing member in the thickness direction thereof.

In this regard, image forming apparatuses, in operation, typically set the temperature of a fixing member thereof so as not to be lower than the temperature of a pressing member thereof. In addition, the heat capacity of the fixing member is typically smaller than that of the pressing member, and the power of a heat source for heating the fixing member is higher than the power of a heat source for heating the pressing member. Therefore, the fixing member thereof typically has much better thermal responsiveness than the pressing member thereof.

Figure 3:
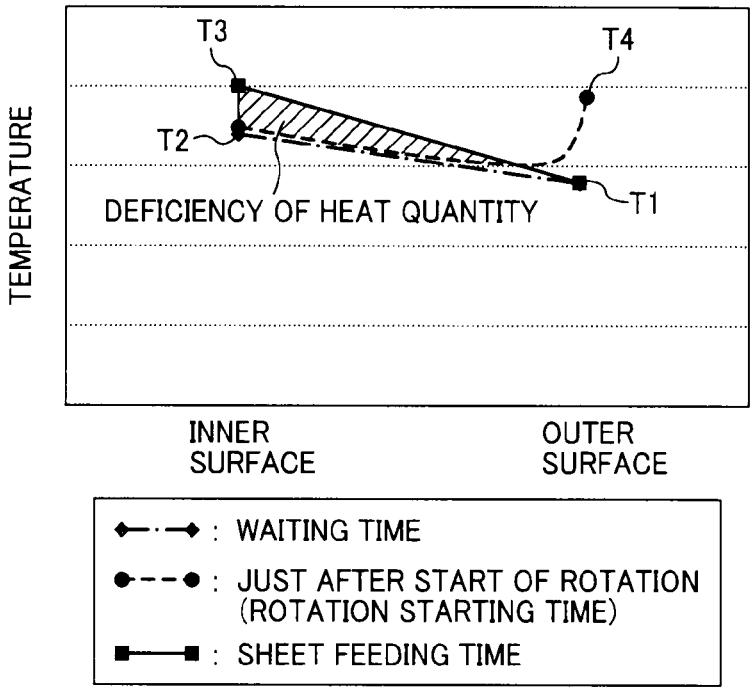
FIG. 3 is a graph illustrating temperature distribution of a pressing member in the thickness direction thereof.
Figure 4:
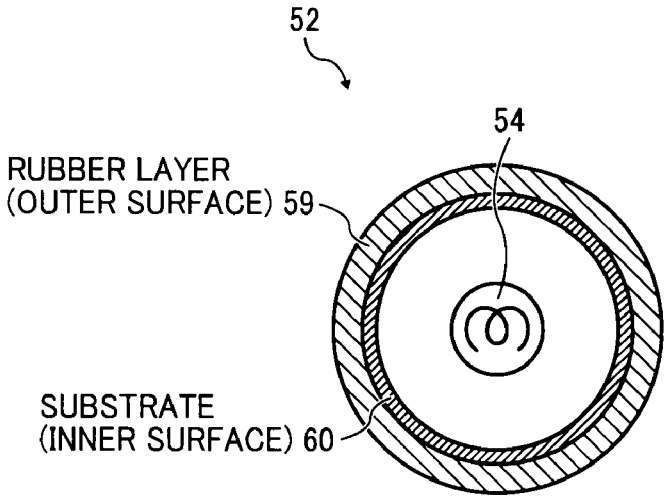
FIG. 4 is a schematic cross-sectional view illustrating a pressing member for use in the fixing device of the present invention.

In FIG. 3, the "inner surface" means the inner surface of a pressing member, for example, the inner surface of a substrate 60 of the pressing roller 52 illustrated in FIG. 4, and the "outer surface" means the outer surface of the pressing member, for example, the outer surface of a rubber layer 59 of the pressing roller 52 illustrated in FIG. 4. Therefore, the thickness of the pressing member, i.e., the distance between the inner surface and the outer surface thereof, is plotted on the horizontal axis of FIG. 3. Specifically, in FIG. 3, the temperature distribution of from the inner surface to the outer surface of the pressing roller in a waiting state is represented with a chain line, the temperature distribution in a state just after start of rotation is represented with a broken line, and the temperature distribution in a sheet feeding state is represented with a solid line.

In FIG. 3, a temperature (T1) of the outer surface of the pressing member in the waiting time is the same as that in the sheet feeding time. The outer surface of the pressing member must have the temperature T1 in the sheet feeding time. Therefore, the pressing member maintains the temperature T1 even in the waiting time so as to be ready for a sheet to be fed to the fixing nip. In order that the outer surface of the pressing member maintains the temperature T1, the inner surface thereof has to have a temperature T2 represented by a black diamond mark (♦) in the waiting time.

In the sheet feeding time, the sheet passing through the fixing nip draws heat from the pressing member. Therefore, in order that the pressing member maintain the temperature T1, it is necessary to apply heat to the pressing member in a quantity greater than that in the waiting time. Therefore, the inner surface of the pressing member has to maintain a predetermined temperature T3 that is higher than the temperature T2. Since the quantity of heat transferred from the inner surface to the outer surface (i.e., from the inner surface to the sheet) is larger than the quantity of heat transferred in the waiting time, the pressing member has the temperature distribution indicated by the solid line in FIG. 3. Specifically, in the sheet feeding time, heat is continuously applied from the inner surface to the outer surface to compensate for the heat drawn by the sheet, i.e., the pressing member in the sheet feeding state has a larger quantity of heat than in the waiting time. The difference in heat quantity corresponds to an area (deficiency of heat quantity) illustrated by slanted lines in FIG. 3. The deficiency of heat quantity will be described in greater detail later.

The temperature distribution of the pressing member will now be described in detail. Since the fixing roller 51 is not rotated in the waiting time, heat transfer is performed only through the fixing nip, and the quantity of heat transferred from the fixing roller to the pressing roller is small. Since the temperature detector 55 for determining the temperature of the surface of the pressing member 52 cannot be disposed at the nip of the pressing member contacted with the fixing member 51 but must be disposed on a portion other than the nip, the heat of the fixing roller hardly influences the temperature of the pressing roller detected by the temperature detector 56.

By contrast, in the state in which the fixing roller 51 rotates, eventually, the entire surface of the fixing roller 51 is contacted with the pressing roller 52 through the nip. In this case, since the temperature of the fixing roller 51 is higher than that of the pressing roller 52, heat is transferred from the fixing roller to the pressing roller.

As a result, in the time just after start of rotation of the fixing roller 51 illustrated by the broken line in FIG. 3, i.e., a rotation starting time of from start of rotation of the fixing roller to arrival of the sheet to the fixing nip, the temperature of the pressing roller 52 increases as illustrated by a black circle mark (●). However, only the temperature of the outer surface of the pressing roller 52 is increased to a temperature T4 in the rotation starting time, and the inner surface of the pressing roller hardly increases because the heat of the fixing roller hardly reaches the inner surface of the pressing roller. Namely, the temperature of the pressing roller 52 is substantially the same as that in the waiting time except for the outer surface thereof. In other words, the pressing roller 52 experiences an apparent temperature increase, and has the deficiency of heat quantity as mentioned above.

In this regard, the temperature of the surface of the pressing roller 52 is detected by the temperature detector 55, and if the surface temperature decreases due to start of rotation of the fixing roller 51, the heat source 54 supplies heat to the pressing roller from inside. However, as stated, in the above-mentioned rotation starting state, the temperature of the outer surface of the pressing roller 52 is increased by the heat from the fixing roller 51, even though the inner portion of the pressing roller is not sufficiently heated (i.e., the whole of the pressing roller 52 is not yet heated). Therefore, the image forming apparatus judges that it is not necessary to heat the pressing roller, and stops supplying heat to the pressing roller.

At this point, when the recording sheet S passes through the fixing nip under such conditions, the sheet draws heat from the pressing roller 52, thereby rapidly decreasing the temperature of the surface of the pressing roller 52, resulting in a net deficiency of heat quantity of the pressing roller. Even though the heat quantity deficiency can be detected and heat is supplied to the pressing roller 52, the temperature of the pressing roller 52 cannot be rapidly raised to the predetermined temperature (i.e., it takes a relatively long time until the pressing roller 52 is heated to the predetermined temperature) because the pressing roller has a considerable thickness and heat capacity, and the power supplied to the heat source 54 is limited. Since the temperature of the surface of the pressing roller 52 is thus affected by the fixing roller 51, the temperature control of the pressing roller cannot be satisfactorily performed, resulting in occurrence of the above-mentioned curling problem, thereby degrading the feeding property of the recording sheet and the fixing property, such that the toner image cannot be satisfactorily fixed to the recording sheet.

FIG. 4 is a schematic cross-sectional view illustrating the pressing roller 52 for use as the pressing member of the fixing device of the present invention. Referring to FIG. 4, the pressing roller 52 has the rubber layer 59 serving as an elastic layer and made of a rubber such as silicone rubbers so that a fixing nip having a predetermined length can be formed between the pressing roller and the fixing roller 51. In addition, the pressing roller 52 has the cylindrical substrate 60, which is made of a metal (such as iron and iron alloys) and has a considerable thickness so as to maintain the shape thereof even when receiving a pressing force from the fixing roller 52. For example, the thicknesses of the rubber layer 59 and substrate 60 are preferably 3 mm and 1 mm, respectively.

Therefore, the pressing roller 52 has a relatively large heat capacity. In addition, the fixing property of a toner image is largely influenced by the temperature of the fixing roller 51. Specifically, preferably the temperature of the fixing roller 51 is controlled primarily and raised more quickly than that of the pressing roller 52. Therefore, it is preferable that the fixing roller 51 have a small heat capacity, and more power is applied to the heat source 53 for heating the fixing roller than that applied to the heat source 54 for heating the pressing roller 52. In this regard, the power consumption of the printer has an upper limit and is as low as possible in view of the need for energy efficiency. Therefore, it is typical that the heat source 54 cannot supply a sufficient quantity of heat to the pressing roller 52, resulting in deterioration of the thermal responsiveness of the pressing roller.

Figure 5:
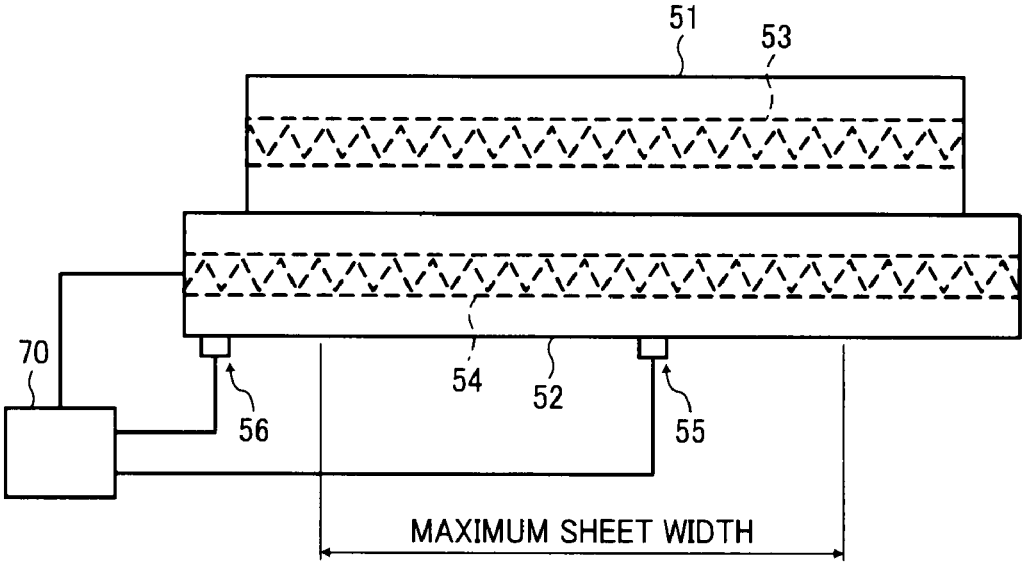
FIG. 5 is a schematic view illustrating an example of the fixing device of the present invention.
Figure 9:
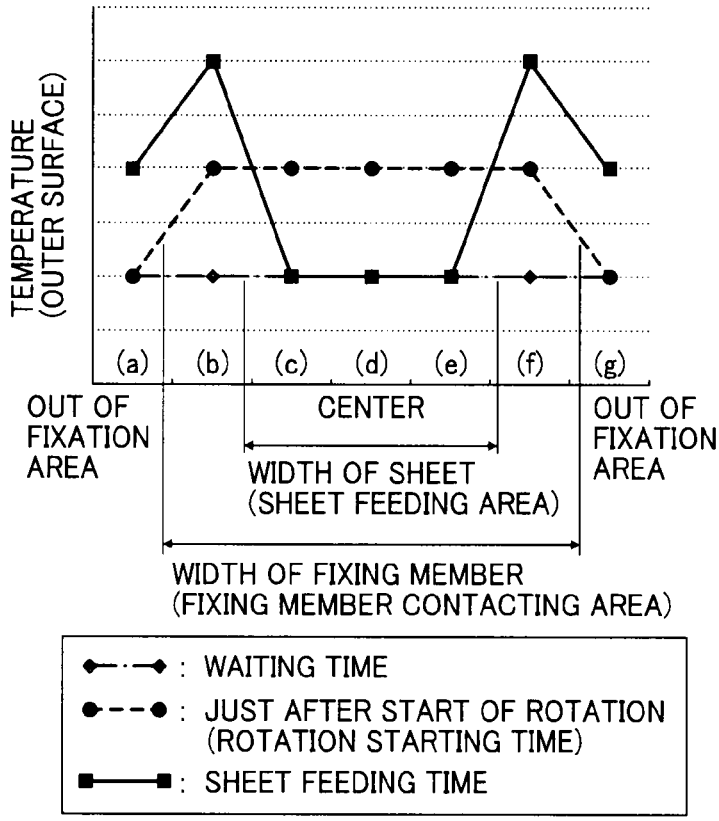
FIG. 9 is a graph illustrating temperature distribution of a pressing member in the width direction thereof.

In order to solve these problems, the fixing device 5, which is one example of the fixing device of the present invention, includes the fixing roller 51, the pressing roller 52 contacting the fixing roller to form a fixing nip at which an unfixed toner image on the recording sheet S is fixed thereto, the first heat source 53 configured to heat the fixing roller 51, the second heat source 54 configured to heat the pressing roller 52, and at least two temperature detectors configured to determine the temperatures of different surface portions of the pressing roller. The width of the pressing roller 52 (i.e., the length of the pressing roller in the longitudinal, or axial, direction thereof) is greater than that of the fixing roller 51 as illustrated in FIG. 5. As illustrated in FIG. 5, the first temperature detector 55, one of the temperature detectors, is provided to measure the temperature of a central surface portion of the pressing roller 52 within a sheet feeding area, and a second temperature detector 56 is provided to measure the temperature of an end surface portion of the pressing roller, which portion is not contacted with the fixing roller even when the fixing roller and pressing roller rotate. Although only one temperature detector is used for each of the temperature detectors 55 and 56 in FIG. 5, plural temperature detectors can be used therefor as illustrated in FIG. 9.

Figure 6:
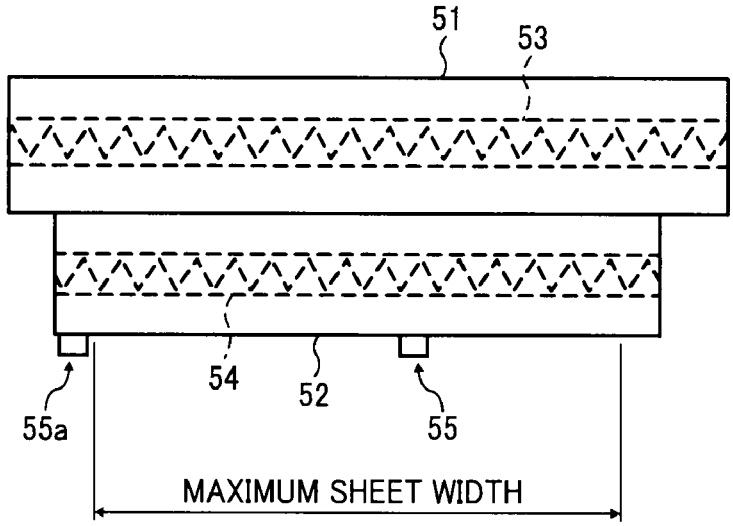
FIG. 6 is a schematic view illustrating a comparative fixing device.

If the width of the pressing roller 52 is less than that of the fixing roller 51 as illustrated in FIG. 6 and a temperature detector 55*a* is arranged to measure the temperature of a surface of a portion of the pressing roller without the sheet feeding area, the temperature of the portion is affected by the fixing roller.

For the reason mentioned above, in the fixing device of the present invention the pressing roller 52 is wider than the fixing roller 51, and the second temperature detector 56 is arranged to measure the temperature of an end surface portion of the pressing roller, which portion is not contacted with the fixing roller, i.e., which does not form a fixing nip with the fixing roller as illustrated in FIG. 5.

The fixing device 5 having such a configuration can control the temperature of the pressing roller 52 without being affected by the heat of the fixing roller.

Hereinafter, an example of the temperature control of the pressing roller 52 according to the present invention will be described, but the temperature controlling is not limited thereto.

The fixing device of the present invention preferably has a controller 70 (illustrated in FIG. 5) configured to control the heat source 54 according to the detection signals from the first and second temperature detectors 55 and 56. The controller 70 properly selects the first temperature detector or second temperature detector depending on the state of the fixing device 5, and controls the heat source 54 based on the detection signal of the selected temperature detector to control the temperature of the pressing roller 52.

At first, temperature control of the pressing roller 52 in the start-up operation time of the printer will be described with reference to FIG. 7.

In the start-up operation time of the printer, power is supplied to each of the heat source 53 for heating the fixing roller 51 and the heat source 54 for heating the pressing roller 52, and the fixing roller and pressing roller are rotated so that the entire surface of each roller has almost the same temperature.

Figure 7:
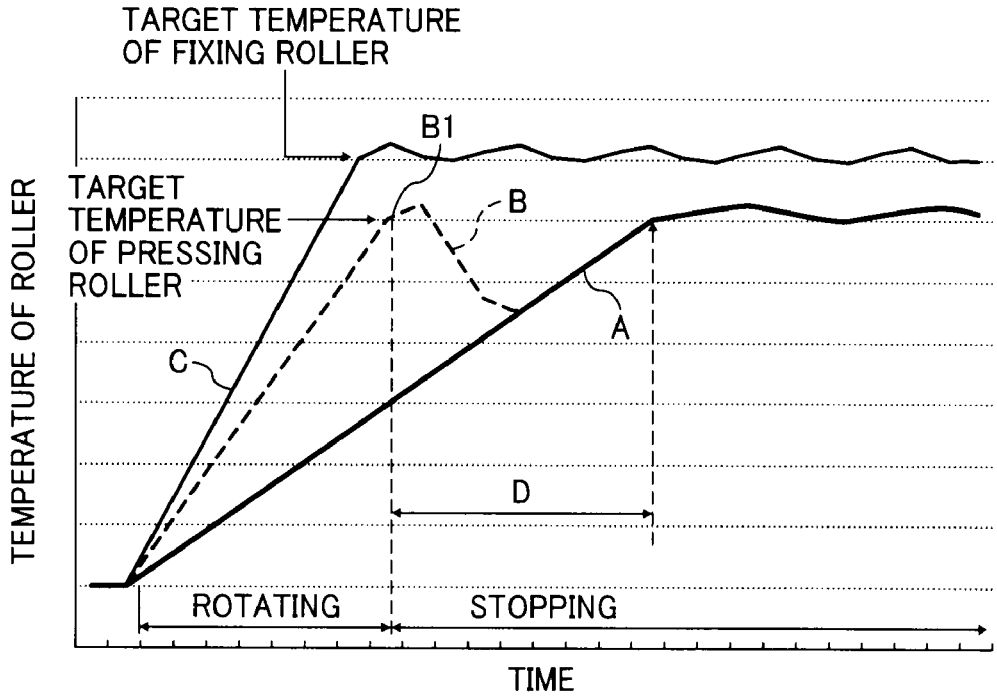
FIG. 7 is a graph illustrating temperature control of a pressing member in a start-up operation time of the image forming apparatus of the present invention.

In FIG. 7, a curve A represents temporal change of the temperature of a surface of the pressing roller 52 in the start-up operation time detected by the second temperature detector 56, a curve B represents temporal change of the temperature of a surface of the pressing roller 52 in the start-up operation time detected by the first temperature detector 56, and a curve C represents temporal change of the temperature of a surface of the fixing roller 51 in the start-up operation time detected by the fixing roller temperature detector 57.

The present inventor confirmed that when the pressing roller 52 is heated only by the heat source 54, the temperature of the surface of the pressing roller 52 changes like the curve A. Therefore, the curve A accurately represents the actual temperature of the pressing roller 52. Accordingly, it is preferable that a fixing operation is performed only after the temperature A reaches the target temperature of the pressing roller. By contrast, the temperature B of a surface of the pressing roller 52 detected by the first temperature detector 56 increases more quickly than the temperature A because the surface of the pressing roller receives is heated by the fixing roller 51. If the controller 70 operates based on the temperature detected only by the first temperature detector 55, the controller judges that the pressing roller 52 is heated to the target temperature (i.e., the start-up operation is completed) and stops rotation of the rollers prematurely, even though the whole of the pressing roller is not sufficiently heated.

When the rotation of the fixing roller 51 and pressing roller 52 are stopped, heat is not supplied from the fixing roller to the pressing roller, thereby decreasing the temperature of the surface of the pressing roller 52 as illustrated by the broken line in FIG. 7. Finally the temperature B becomes substantially the same as the temperature A. If the printer performs an image forming operation based on this determination of completion of the start-up operation, however, the recording sheet S passing through the fixing nip draws heat from the pressing roller 52, resulting in decrease of the temperature of the pressing roller, thereby largely curling the recording sheet (i.e., forming a curled print).

Therefore, in the fixing device of the present invention, the controller operates based on the temperature detected by the second temperature detector 56 to reduce the degree of curling of the recording sheet S after the fixing operation, resulting in prevention of occurrence of a jamming problem in that the recording sheet jams in a passage of from the fixing device 5 to the pair of discharging rollers 3 (i.e., resulting in improvement of feeding property of the recording sheet), and a defective stacking problem in that prints are defectively stacked on a copy tray due to curling thereof.

However, when performing temperature control based on the temperature detection signal from the second temperature detector 56 to reduce the degree of curling of the recording sheet 5, the start-up operation takes a relatively long time. Therefore, the printer has two settable conditions, enabling a determination to be made whether to place a higher priority on reduction of curling or shortening of the start-up operation time By selecting temperature detection by the first temperature detector 55 or temperature detection by the second temperature detector 56 as appropriate, it becomes possible to reduce curling of the recording sheet or shorten the start-up operation time according to demand of the user.

It is preferable to previously determine a proper rotation stopping time empirically based on the detection signals of both the first and second temperature detectors 55 and 56. For example, it is preferable to perform controlling such that at a time in a period D illustrated in FIG. 7, which is an empirically predetermined time after the temperature B reaches the target temperature, rotation of the rollers is stopped or the image forming operation is started.

Next, temperature control of the pressing roller in the sheet feeding time of the printer following the waiting time thereof will be described. When temperature control is performed based on the temperature detected by the first temperature detector 55 illustrated by a broken line in FIG. 8, the temperature of the surface of the pressing roller 52 shows an apparent increase (as illustrated by the broken line in FIG. 3) when the fixing roller 51 and pressing roller start to rotate, due to the heat transferred from the fixing roller. Therefore, the controller 70 stops supply of power to the heat source 54 in a period E illustrated in FIG. 8. When the recording sheet S is fed to the fixing nip under such a condition, the recording sheet draws heat from the surface of the pressing roller 52, thereby rapidly decreasing the temperature of the pressing roller. In this regard, when the first temperature detector 55 detects that the temperature of the pressing roller 52 is lower than the target temperature, power supply to the heat source 54 is restarted. However, since the inner portion of the pressing roller 52 is lacking in heat quantity in the non-activating period (i.e., the period E) due to stopping of the supply of power to the heat source 54 based on detection of the apparent temperature of the pressing roller, it takes time for the heat to be transferred to the surface of the pressing roller, and the temperature of the surface of the pressing roller falls sharply so as to be lower by G than the target temperature as illustrated in FIG. 8.

Figure 8:
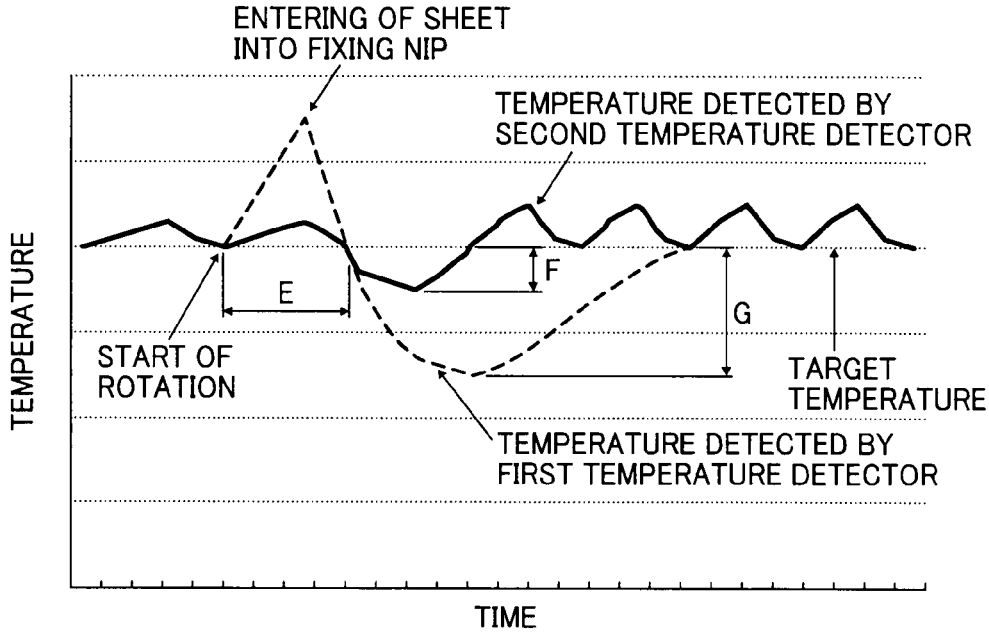
FIG. 8 is a graph illustrating temperature control of a pressing member of the fixing device of the present invention in a period from a waiting time to a returning time.

By contrast, when heat controlling is performed based on the temperature detected by the second temperature detector 56 as illustrated by a solid line in FIG. 8, the temperature of the end portion of the pressing roller 52 is controlled without being affected by the heat of the fixing roller 51 because heat is not transferred to the end portion even when the rollers rotate. Therefore, the pressing roller 51 maintains the proper state even when the rollers rotate. When the recording sheet S is fed to the fixing nip under such conditions, the temperature of the pressing roller 52 changes like a curve illustrated by the solid line in FIG. 8 while the temperature drop (i.e., B in FIG. 8) of the pressing roller is minimized. This is because the pressing roller 52 has been subjected to proper heat control until just before contact of the roller with the recording sheets, and power starts to be supplied to the heat source 54. Therefore, the temperature of the pressing roller 52 can be rapidly returned to the target temperature.

As mentioned above, in the sheet feeding state of the printer following the waiting state thereof, the controller 70 controls the temperature of the pressing roller 52 based on the temperature detected by the second temperature detector 56, and therefore no image forming operation is performed when the temperature of the pressing roller 52 is lower than the target temperature, thereby making it possible to reliably produce a print having little curl and good feeding property.

FIG. 9 is a graph illustrating temperatures of seven different points (a)-(g) along the surface of the pressing member in the width direction thereof in the waiting time, rotation starting time, and sheet feeding time. Among the seven points, three points (c), (d) and (e) are located in the sheet feeding area (i.e., the central area), two points (b) and (f) are located within a fixing member contacting area and out of the sheet feeding area, and other two points (a) and (g) are located out of the fixation area.

As illustrated in FIG. 9, the temperatures of the seven points are the same in the waiting time. However, when the fixing member and pressing member start to rotate, the temperatures of the five points (b)-(f) within the fixing member contacting area are increased. By contrast, the temperatures (a) and (g) of the end portions are not increased and maintain the temperature thereof in the waiting time because the end portions are not affected by the heat of the fixing member. Therefore, when temperature detection is performed at the end points (a) and (g) out of the fixing member contacting area, more accurate temperature detection can be carried out unaffected by the above-mentioned apparent increase in temperature of the pressing member. When the recording sheet is continuously fed to the fixing device while the pressing member is heated, the temperatures of the points (a), (b), (f) and (g) become higher than the central points (c), (d) and (e) located in the sheet feeding area because the recording sheet draws heat from the central portions of the pressing member. In this regard, the points (b) and (f) have a higher temperature than the points (a) and (g) because of receiving heat from the fixing roller.

When control based on the temperature detected by the second temperature detector 56 is continued even in the sheet feeding time, the temperature of the pressing member in the sheet feeding area gradually decreases. Therefore, it is preferable to control based on the temperature detected by the first temperature detector 55 in the continuous sheet feeding time. Whether or not to perform the switching operation is determined, for example, based on the number of the continuously fed recording sheets or the continuous sheet feeding time (i.e., continuous image forming time). Namely, the switching operation is performed when the number of the continuously fed recording sheets or the continuous sheet feeding time exceeds a predetermined threshold value. It is preferable that the user can determine the threshold value.

Performing such temperature control makes it possible to reliably produce prints having a good fixing property while reducing curling of the prints even at the beginning of an image forming operation or in a continuous image forming operation.

In addition, the fixing device of the present invention can detect abnormal temperature of the pressing member (i.e., abnormality of the fixing device) based on both the temperatures detected by the first and second temperature detectors 55 and 56 more easily than a fixing device using only one temperature detector, providing improved reliability. For example, even when one of the temperature detectors is damaged, abnormality of the fixing device (such as overheating of the pressing member) can be detected by another temperature detector, and thereby controlling such that the fixing device is stopped can be performed, resulting in prevention of formation of defective prints and damage to the fixing device.

The image forming apparatus of the present invention includes an image forming device configured to form a toner image on a recording sheet, and the above-mentioned fixing device configured to fix the toner image to the recording sheet. Therefore, the image forming apparatus of the present invention can stably produce prints having a good fixing property and little curl without causing sheet jamming and defective stacking. In this regard, the image forming units 101, the transferring device including the intermediate transfer belt 1, primary transfer members 11, and secondary transfer member 4, the light irradiating device 9 illustrated in FIG. 1, etc. constitute the image forming device.

The fixing device of the present invention is not limited to the above-mentioned example. That is, the above-mentioned fixing device is a roller fixing device. However, the present invention is not limited thereto, and can be applied to belt fixing devices as described below.

Figure 10:
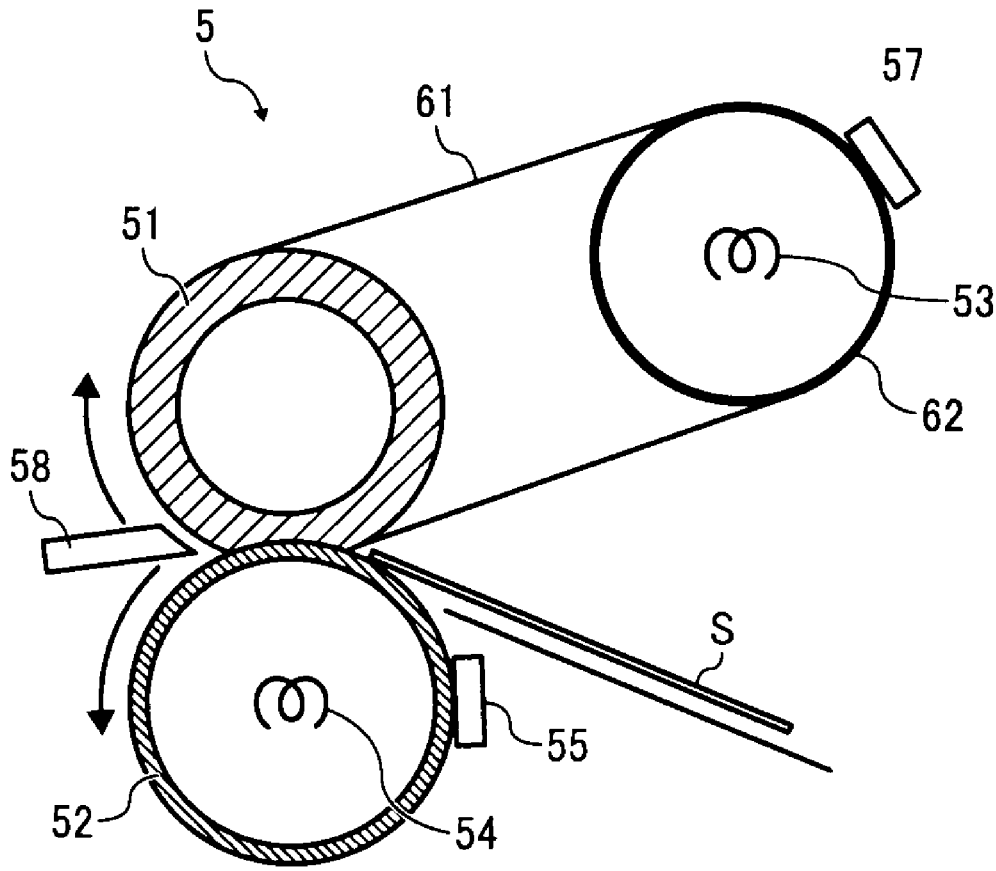
FIG. 10 is a schematic view illustrating a single-belt fixing device as one example of the fixing device of the present invention.

FIG. 10 illustrates a belt fixing device having a fixing belt 61 serving as a fixing member, a support roller 62 supporting the fixing belt together with the fixing roller 51, and the pressing roller 52. The temperature detectors 55 and 56 are disposed to determine the temperatures of surface portions of the pressing roller 52, although the temperature detector 56 is not illustrated in FIG. 10.

Figure 11:
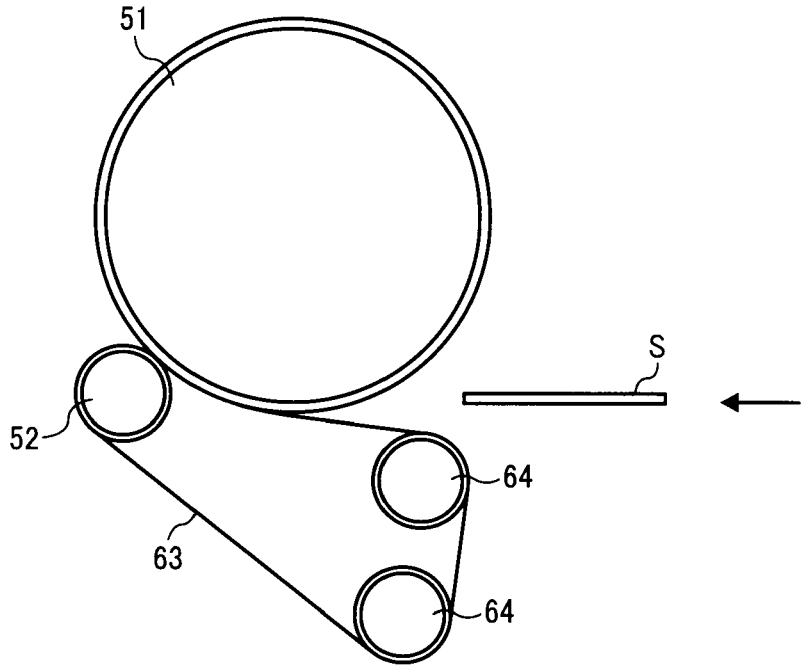
FIG. 11 is a schematic view illustrating another single-belt fixing device as one example of the fixing device of the present invention.

FIG. 11 illustrates another belt fixing device having a pressing belt 63, which is rotated and supported by the pressing roller 52 and support rollers 64. The recording sheet S bearing an unfixed toner image thereof is fed to the fixing nip formed by the fixing roller 51 and the pressing belt 63 so that the toner image is fixed to the recording sheet at the fixing nip. In FIG. 11, heating sources for heating the pressing belt 63 and fixing roller 51, and temperature detectors for detecting the temperatures of the fixing roller 51 and pressing belt, not illustrated.

Figure 12:
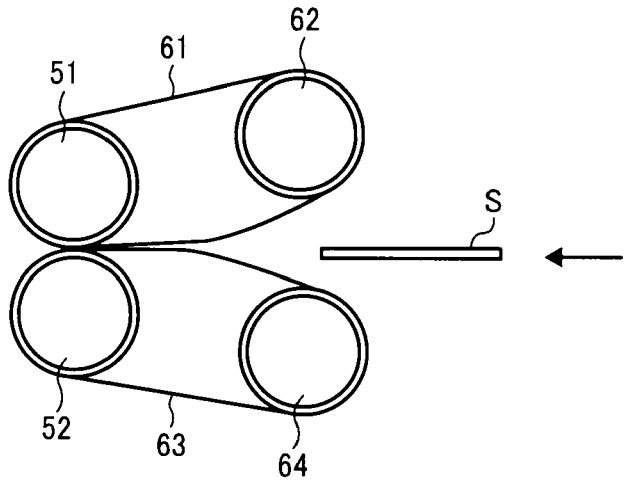
FIG. 12 is a schematic view illustrating a twin-belt fixing device as one example of the fixing device of the present invention.

FIG. 12 illustrates a twin belt fixing device having the fixing belt 61, which is rotated and supported by the fixing roller 51 and support roller 62, and the pressing belt 63, which is rotated and supported by the pressing roller 52 and support roller 64. In FIG. 12, heating sources for heating the fixing belt 61, pressing belt 63, fixing roller 51, and pressing roller 52, and temperature detectors for detecting the temperatures of the fixing belt and pressing belt, are not illustrated.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2009-211618 and 2010-115405, filed on Sep. 14, 2009, and May 19, 2010, respectively, the entire contents of which are herein incorporated by reference.

What is claimed is:

1. A fixing device for fixing a toner image on a recording sheet, comprising:

a first heat source;

a second heat source;

a rotatable fixing member heated by the first heat source and having a width greater than a maximum width of the recording sheet accommodated by the fixing device;

a rotatable pressing member heated by the second heat source and contacting the fixing member to form a fixing nip therebetween at which a toner image on a recording sheet passing therethrough is fixed thereto, the pressing member having a width greater than the width of the fixing member; and at least first and second temperature detectors configured to determine temperatures of different surface portions of the pressing member, the first temperature detector determining a temperature of a first surface portion of the pressing member, which is contacted with the recording sheet when the recording sheet is fed to the fixing nip, and the second temperature detector determining a temperature of a second surface portion of the pressing member, which is not contacted with the fixing member even when the pressing member is rotated.

2. The fixing device according to claim 1, further comprising:

a controller configured to selectively control the second heat source based on the temperature detected by the first temperature detector or the temperature detected by the second temperature detector.

3. The fixing device according to claim 2, wherein when the controller performs heat control in a start-up operation time of the fixing device, the controller selects either the temperature detected by the first temperature detector or the temperature detected by second temperature detector according to preset information.

4. The fixing device according to claim 2, wherein in a returning time of the fixing device following a waiting time thereof, the controller performs heat control based on the temperature detected by the second temperature detector.

5. The fixing device according to claim 2, wherein in a continuous sheet feeding time of the fixing device, the controller switches from heat control based on the temperature detected by the second temperature detector to heat control based on the temperature detected by the first temperature detector.

6. The fixing device according to claim 2, wherein when one of the first and second temperature detectors detects an abnormal temperature, the controller performs heat control based on the temperature detected by the other temperature detector.

7. An image forming apparatus comprising:

an image forming device configured to form a toner image on a recording sheet; and the fixing device according to claim 1 configured to fix the toner image to the recording sheet.

* * * * *